US006105626A

United States Patent [19]

Debaes et al.

[11] Patent Number: 6,105,626

[45] Date of Patent: Aug. 22, 2000

[54] GRIPPER RAPIER WEDGE GAP ARRANGEMENT

[75] Inventors: Johnny Debaes, Moorslede; Bart Nys, Moorsele, both of Belgium

[73] Assignee: N. V. Michel Van de Wiele, Kortrijk/Marke, Belgium

[21] Appl. No.: 09/350,136

[22] Filed: Jul. 9, 1999

[30] Foreign Application Priority Data

Jul. 9, 1998 [BE] Belgium ..... 09800523
May 28, 1999 [BE] Belgium ..... 09900371

[51] Int. Cl.[7] ..... D03D 47/23

[52] U.S. Cl. ..... 139/448; 24/132 R

[58] Field of Search ..... 139/448, 438; 24/132 R

[56] References Cited

U.S. PATENT DOCUMENTS

| | | | |
|---|---|---|---|
| 3,613,740 | 10/1971 | Geiger | 139/122 |
| 4,040,454 | 8/1977 | Genini . | |
| 4,371,008 | 2/1983 | Freisler | 139/348 |
| 5,558,133 | 9/1996 | Bortili et al. | 139/448 |

FOREIGN PATENT DOCUMENTS

| | | |
|---|---|---|
| 1 559 836 | 3/1969 | France . |
| 2 230 370 | 3/1977 | France . |
| 75 11 176 | 3/1976 | Netherlands . |
| 1 510 426 | 5/1978 | United Kingdom . |

*Primary Examiner*—Andy Falik
*Attorney, Agent, or Firm*—James Creighton Wray; Meera P. Narasimhan

[57] ABSTRACT

A gripper rapier provision for weaving machines with a fixed gripper rapier body has a hook and a gripping face on the inside of the hook. A hinged clip suspended from the fixed gripper rapier body, with a gripping face thereon, works together with the gripping face of the hook to grip a weft thread taken by the gripper rapier provision. A mechanism is provided in front of the extremity of the gap, formed by the gripping face of the hinged clip and the gripping face of the hook, for preventing the weft thread from sliding to the extremity of the gap. It consists of a bar provided on the gripping face of the hook of the gripper rapier body working together with a hole in the hinged clip, or a bar running through the extremity of the hook of the gripper rapier body working together with a hole in the hook of the gripper rapier body, or a bar provided on the hinged clip working together with a hole in the hook of the gripper rapier body. A projecting surface may be provided in the extremity of the hook of the gripper rapier body which works together with a hole in the hinged clip.

10 Claims, 4 Drawing Sheets

A
B
X
Y
Z

GRIPPER RAPIER WEDGE GAP ARRANGEMENT

BACKGROUND OF THE INVENTION

The invention relates to a gripper rapier provision for weaving machines which work according to the principle of split rapiers.

With such weaving machines, the so-called rapier weaving machines, rapier rods are disposed on either side of the weaving machine in order to insert the weft threads. The total insertion cycle is divided into three phases: the presenting phase, the insertion phase and the pulling-through phase. During the insertion phase the rapiers move together on the forward path out of a starting position to the middle of the fabric and on the return path from the middle to the starting position. In the starting position the weft thread is presented to a donor rapier. In the middle of the fabric, the weft thread is taken over by a gripper rapier and with the return movement the weft thread is pulled through from the middle of the fabric up to the fell of the fabric.

The gripper rapier can for example consist of a fixed gripper rapier body provided with a hook with a gripping face on the inside of the hook, and of a hinged clip suspended from that fixed gripper rapier body, which with a gripping face thereon works together with the gripping face of the hook in order to grip a weft thread taken by the gripper rapier.

The Belgian patent publication no. 844 865 describes such a gripper rapier which is used for the weft insertion. That gripper rapier consists of a hook for pulling the weft thread out of the donor rapier, and in that hook a hinged clip is mounted in order to keep the weft thread gripped during the pulling-through phase.

In practice it appears that gripper rapiers known from the state-of-the-art can cause problems.

Thus during the insertion phase the weft thread is initially accelerated from standstill from the starting position up to a high speed; because of this a tensile force develops in the weft thread as a result of the mass inertia of the yarn. When reaching a high insertion speed a resistance providing force develops in the weft thread as a result of the friction arising in the guiding eyes. The clamping in the gripper rapier must be capable of overcoming these tensile forces with sufficient safety.

The Belgian patent publication no. 844 865 describes a few measures for this purpose: an opening is provided on the hinged clip and a projecting rib is provided on the wedge surface of the hook in order to clamp the weft thread onto ribbed surfaces. When the tensile force in the weft thread becomes great the clamped weft thread slides further under the clip and is in this manner pulled out of the clip. This causes a weft insertion fault and this is detected by the weft check device of the weaving machine which generates a stop signal. The efficiency of the weaving machine will therefore decrease.

With the increasing weaving machine speeds and especially when weaving heavy jute threads in yarn number range from 210 tex to 2×840 tex, this problem becomes rather acute. As a measure the clamping pressure can be increased by incorporating a stronger spring with higher spring pretension. The thread clip however has to be pressed open at the end of the pulling-through phase and for this a greater pressure force is then required in order to release the weft thread. This causes wear and tear on the operating surfaces. When the clamping pressure is made too high a thick weft thread is difficult to pull into the clamping wedge during the middle takeover. Furthermore the gripper hook can fail under the too great a clamping pressure, through which the hook top breaks off. It is very important to keep the mass of the gripper rapier as low as possible, to lessen the mass effect of the rapier rods, a strengthening of the gripper hook is therefore not an adequate solution.

A further problem can arise at the end of the pulling-through phase, when the gripper clip is pressed open in order to release the inserted weft thread. During the last number of cm movement of the gripper rapier the released weft thread is pulled out of the gripper hook, whereby the weft end is guided in a loop between the open clip and the gripper hook. When a bulge or a knot is present in the weft yarn end that has to be pulled out, the weft yarn remains sticking in the open gap between clip and gripper rapier hook. With the next stop movement of the weaving reed the piece of weft thread is pulled and the broken-off yarn end remains sticking in the rapier hook. With the next takeover of a new weft thread to be inserted the weft thread is no longer clamped and this is the cause of a standstill of the weaving machine for weft thread breakage. Because of this the efficiency of the weaving machine decreases. This phenomenon frequently occurs when weaving carpets where the use of thick jute yarns is common. In a bobbin of jute yarns there are many knots and also bulges. This gives rise to frequent stoppages of the weaving machine for weft thread breakage.

The moment at which the moving rapier releases the weft thread with the gripper rapiers according to the state-of-the-art also appears not always to be the correct one, and the rapier clip is not always sufficiently open, and it also does not remain sufficiently uniformly open during a part of the path of the still moving rapier. In fact the weft thread should be able to be released with a still moving rapier, so that the weft yarn can already be pulled out of the clip out of a still moving rapier.

The gripper rapier heads according to the state-of-the-art therefore also have the following two deficiencies:

- the release gap is too narrow to allow bulges or knots through;
- the opening of the clip does not remain constant during the movement of the rapier.

SUMMARY OF THE INVENTION

The purpose of this invention is to provide a solution to the disadvantages which are associated with the gripper rapiers known at present.

For that purpose the invention puts forward a gripper rapier provision for weaving machines, comprising

- a fixed gripper rapier body provided with a hook and a gripping face on the inside of the hook, and
- a hinged clip suspended from the fixed gripper rapier body, which with a gripping face thereon, works together with the gripping face of the hook in order to grip a weft thread taken by the gripper rapier provision,
- whereby in front of the extremity of the gap formed by the gripping face of the hinged clip and the gripping face of the hook a mechanism is provided which prevents the weft thread from sliding to the extremity of the gap.

According to a further characteristic of the invention the gripper rapier provision can be so implemented that with the thread clip in closed position the gripping face of the hinged clip and the gripping face of the hook form a wedge-shaped space. Moreover the mechanism which prevents the weft thread from sliding to the extremity of the wedge preferably consists of a projection which sticks into the wedge-shaped space.

According to a first preferred embodiment of the invention the mechanism which prevents the weft thread from sliding to the extremity of the gap consists of a bar that is provided on the gripping face of the hook of the gripper rapier provision and which works together with a hole in the hinged clip.

According to a second preferred embodiment of the invention that mechanism consists of a bar that runs through the extremity of the hook of the gripper rapier body and which works together with a hole in the hinged clip.

According to a third preferred embodiment of the invention that mechanism consists of a bar that is provided on the hinged clip and which works together with a hole in the hook of the gripper rapier body.

According to a fourth preferred embodiment of the invention that mechanism consists of a projecting surface that is provided in the extremity of the hook of the gripper rapier body and which works together with a hole in the hinged clip.

In order to make the clamping gap opening larger with an open hinged clip (the clip), according to a further embodiment of the invention, a hole can furthermore be provided in the gripper rapier body near the gripping face of the hinged clip, in which the clip part of the hinged clip can turn aside with the opening of the clip. In other words in the body of the gripper hook a hole (namely an opening or window) is provided into which the clamping part of the hinged clip can turn aside, so that the entire slot of the gripper hook becomes available for the sliding-out of the weft yarn.

Making a hole in the body of the gripper hook is a weakening, and in order to provide the necessary strengthening, according to an additional characteristic of the invention, strengthening ribs, namely projecting ribs on the upright surfaces of the body of the gripper hook, can be provided on the gripper rapier body, near the aforesaid hole in the gripper rapier body.

In order on the other hand to keep the opening of the clip constant during a part of its movement path, according to yet a further embodiment of the invention, such a form can furthermore be given to the hinged clip (the clip shank), that the leg of the hinged clip that is the more remote from the gripping face is made such that, in closed clip position, the part of the hinged clip sticking out of the gripper rapier body projects wedge-shaped, and in open clip position, the hinged clip runs predominantly parallel to the gripper rapier body, or in other words that with a closed clip the back of the hinged clip sticks out of the body of the gripper hook like a wedge and with a completely open clip the hinged clip lies against the body of the gripper hook and remains parallel to this. In this manner the gripper rapier head can move a number of cm without the opening of the rapier clip being changed.

The characteristics and distinctive features of the invention, and its operation are further explained below with reference to the attached drawings which show the various preferred embodiments of the invention. It should be noted that the specific aspects of those embodiments are only described as preferred examples of what is intended in the scope of the above general specification of the invention, and may in no way be interpreted as a restriction on the scope of the invention as such and as expressed in the following claims.

In these drawings:

DETAILED DESCRIPTION

In the figures the gripper rapier is indicated in its entirety by the reference number (1), the gripper rapier body by the reference number (2) and the hinged clip by the reference number (3).

Figure 1:
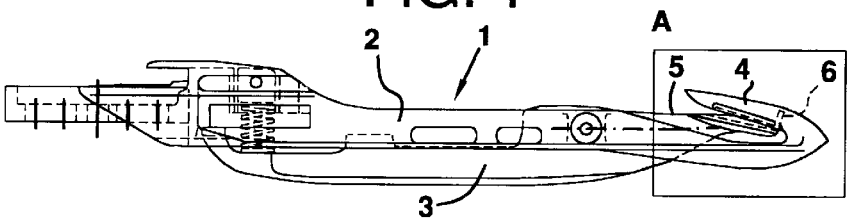
FIG. 1: is a view from above of a first embodiment of the gripper rapier according to the invention.
Figure 2:
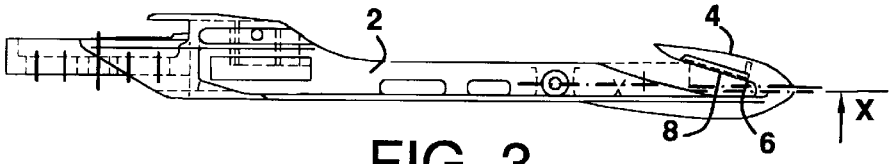
FIG. 2: is a view from above of the fixed gripper rapier body of the gripper rapier according to FIG. 1.
Figure 3:
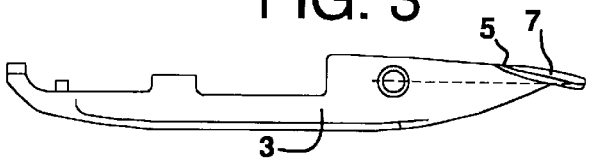
FIG. 3: is a view from above of the hinged clip of the gripper rapier according to FIG. 1.
Figure 4:
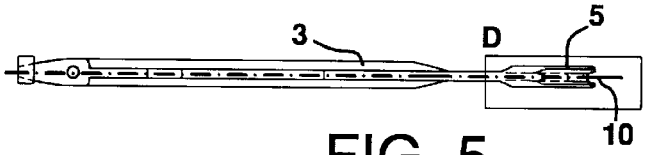
FIG. 4: is a side elevation of the hinged clip according to FIG. 3.
Figure 5:
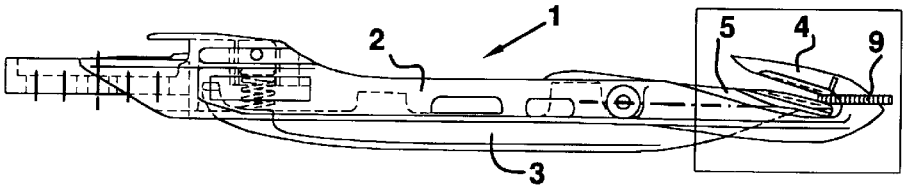
FIG. 5: is a view from above of the gripper rapier according to FIG. 1, shown with a clamped weft thread.
Figure 6:
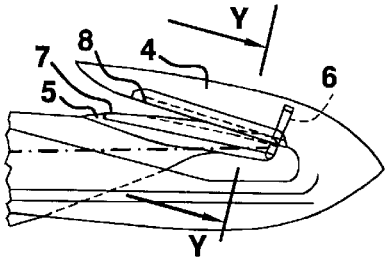
FIG. 6: is an enlargement of part A from FIG. 1.
Figure 7:
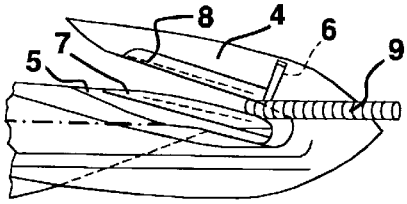
FIG. 7: is an enlargement of part B from FIG. 5.
Figure 8:
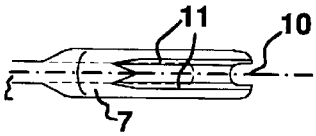
FIG. 8: is an enlargement of part D from FIG. 4.
Figure 9:
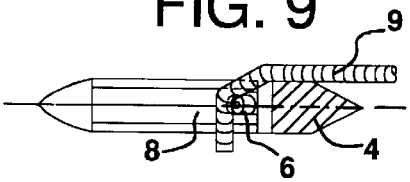
FIG. 9: is a cross-section according to plane X—X from FIG. 2.
Figure 10:
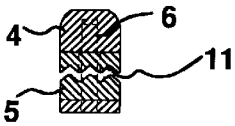
FIG. 10: is a cross-section according to plane Y—Y from FIG. 6.
Figure 11:
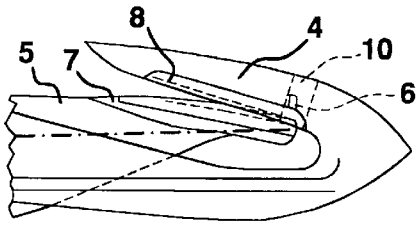
FIG. 11: is a detailed view from above (hook and clip part) of a second embodiment of the gripper rapier according to the invention.
Figure 12:
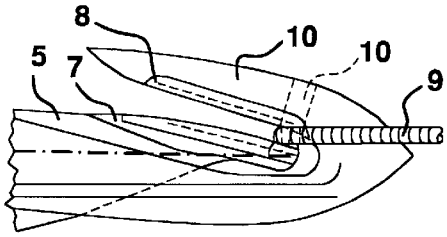
FIG. 12: is a detailed view from above corresponding to FIG. 11, shown with a clamped weft thread.

As illustrated in the drawings according to the invention a mechanism or projection (6)—e.g. a bar or a projecting surface—is provided in the gripper rapier (1) in front of the extremity (right in the figures) of the gap formed by the gripping face (7) of the hinged clip (5) and the gripping face (8) of the hook (4), in order to prevent the weft thread (9) from being pulled out of the gripper rapier by too great a tensile force when utilizing a moderate clamping pressure. In the hinged clip (5) a hole (10) is provided in order to allow the projection (6) through. When a weft thread (9) is pulled to the top of the hook (4), that means toward the extremity (right in the figures) of the gap formed by the gripping face (7) of the hinged clip (5) and the gripping face (8) of the hook (4), the weft thread (9) slides up to the projection (6) and comes to lie there with a loop around the projection (6). This prevents the weft thread (9) from being pulled out of the clip and a small part of the weft thread (9) always comes to lie across the gripping faces (7, 8) between the hinged clip (5) and the gripper hook (4). In the gripping faces of hinged clip and gripper hook a toothing (11) is provided which fits together (in particular see FIGS. 8 and 10). This toothing now always engages on a transverse piece of weft thread through which the clamping becomes rather effective even with moderate clamping pressures. By reducing the clamping pressure the thick weft yarn comes more easily between the gripping faces: the middle takeover therefore becomes more reliable. The weft thread is no longer lost during weaving, the gripper hook lasts longer and the gripper rapier opening faces are no longer subject to such wear and tear. The weaving machine can operate at higher weaving speeds with a reasonable efficiency.

In the embodiment according to FIGS. 1 through 10 a bar (6) is mounted at the top in the wedge surface of the gripper hook (4) in order to prevent the weft thread from sliding out of the gripper rapier.

The same result is also achieved by providing a projection or bar (6) on the top of the clip (5) and an opening in the gripper hook (4) (see drawings 11 and 12).

Figure 13:
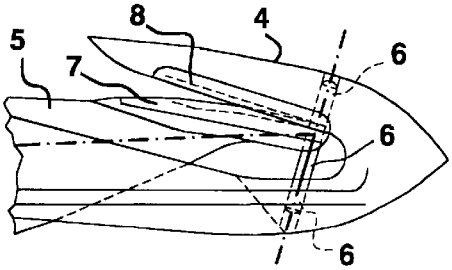
FIG. 13: is a detailed view from above (hook and clip part) of a third embodiment of the gripper rapier according to the invention.
Figure 14:
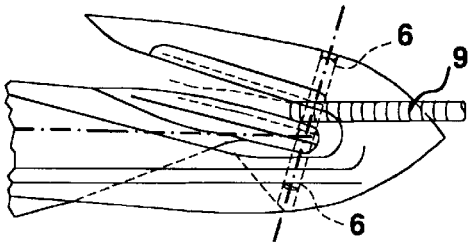
FIG. 14: is a detailed view from above corresponding to FIG. 13, shown with a clamped weft thread.
Figure 15:
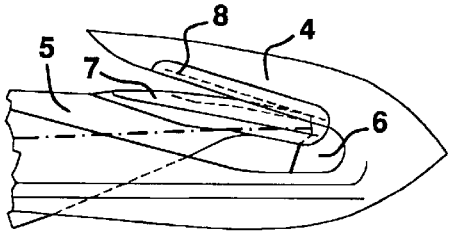
FIG. 15: is a detailed view from above (hook and clip part) of a fourth embodiment of the gripper rapier according to the invention.
Figure 16:
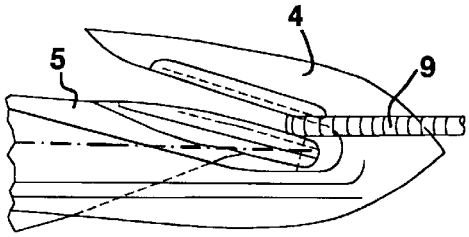
FIG. 16: is a detailed view from above corresponding to FIG. 15, shown with a clamped weft thread.
Figure 17:
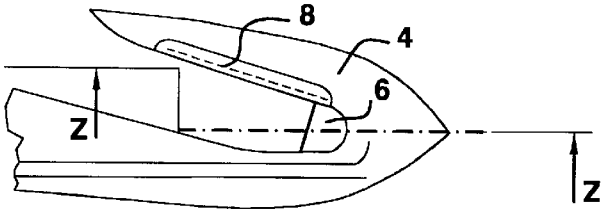
FIG. 17: is a view from above of a part (hook part) of the fixed gripper rapier body of the embodiment according to FIG. 15.
Figure 18:
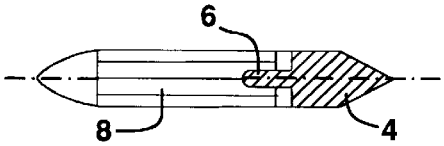
FIG. 18: is a cross-section according to plane Z—Z from FIG. 17.

As illustrated in FIGS. 13 and 14 it is also possible to insert the bar or pin (6) transversely through the gripper point. Because of this the same result is achieved for the takeover, but the rapier head fouls less easily (the thread cannot shoot over the pin), and the pin will break off less easily (is supported on 2 sides).

This can also be achieved by leaving a surface (6) in the middle in the finish of the rapier point, where the clip (with slot) then slides over (see FIGS. 15 through 18).

In order to avoid wear and tear the bar is preferably made out of hard metal or another hardened material.

In the embodiment according to FIGS. 19–25 a hole (12) is provided below in the body of the gripper point (4), as an opening or window, in which the extremity of the hinged clip (5) can turn aside. This is particularly well visible in the enlarged illustration of the gripper point in FIG. 22 and 23.

Because of the hole (12) when opening the rapier clip a better opening is obtained between the gripping faces (7) and (8), so that the weft yarn can slide more easily out of the gripper rapier.

Figures 19, 20, 21, 22, 23, 24, 25:
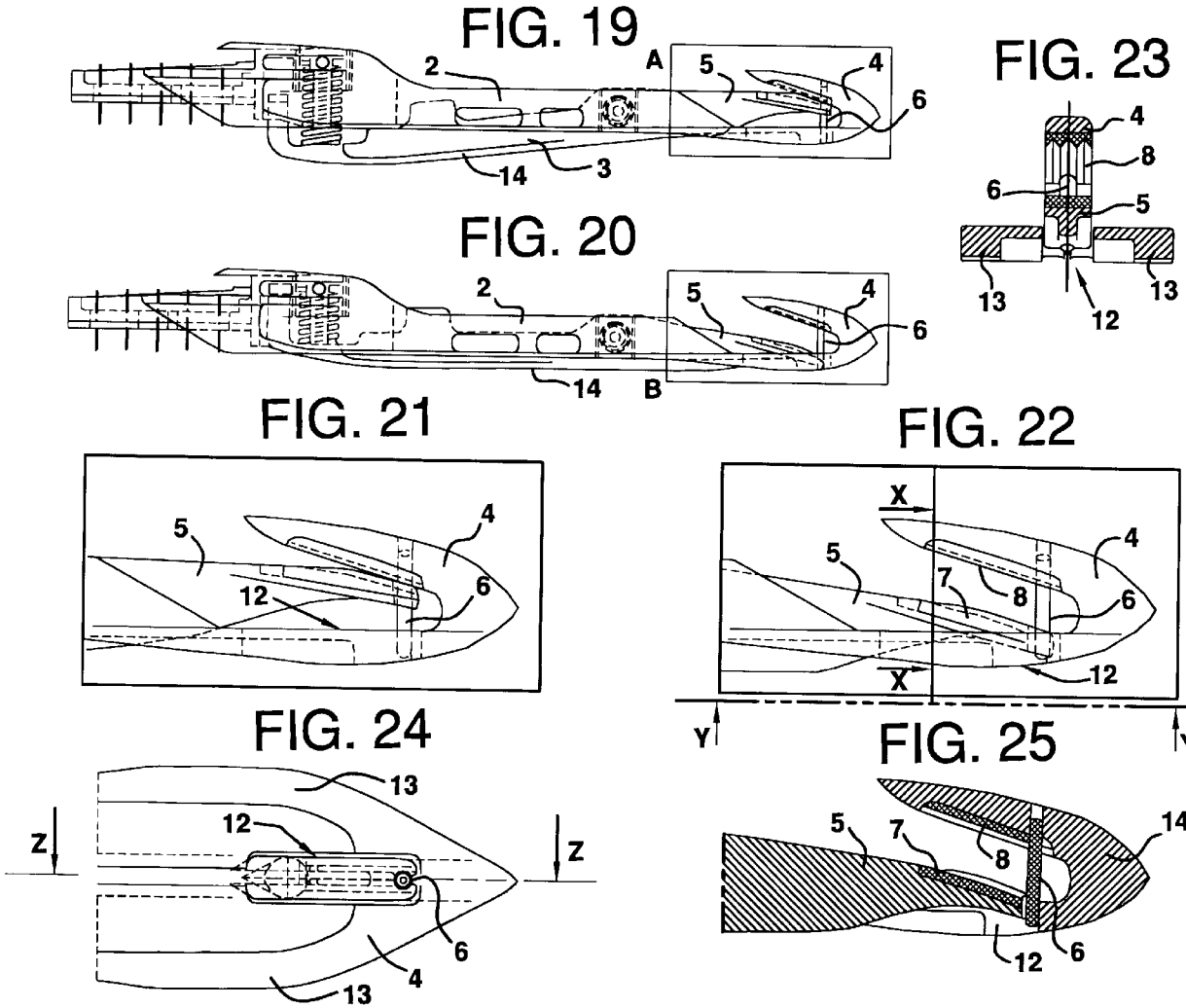
FIG. 19: is a view from above of a fifth embodiment of the gripper rapier according to the invention, shown in closed clip position.
FIG. 20: is a view from above of the gripper rapier according to FIG. 19, shown in open position.
FIG. 21: is an enlargement of part A from FIG. 19.
FIG. 22: is an enlargement of part B from FIG. 20.
FIG. 23: is a cross-section according to plane X—X from FIG. 22.
FIG. 24: is a cross-section according to plane Y—Y from FIG. 22.
FIG. 25: is a cross-section according to plane Z—Z from FIG. 24.

In order to compensate the weakening, which the hole could cause in the body of the gripper point (4), projecting ribs (13) are provided along the lateral surfaces of the gripper point (in particular see FIG. 23).

The form of the hinged clip of the gripper rapier according to FIGS. 19–25 is furthermore so made, that, with a closed clip the back of the clip shank (14)—i.e. the front of the hinged clip (3)—sticks out of the body of the gripper rapier (2) like a wedge (see FIG. 19), and with an open clip the clip shank (14) lies almost level with the body of the gripper rapier, and parallel thereto (see FIG. 20).

Figure 26A:
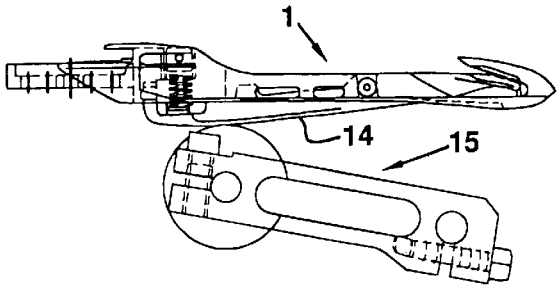
FIGS. 26*a*–26*d*: are views from above of successive situations of a gripper rapier according to FIG. 19, shown with the drive roller for the clamping mechanism.
Figure 26B:
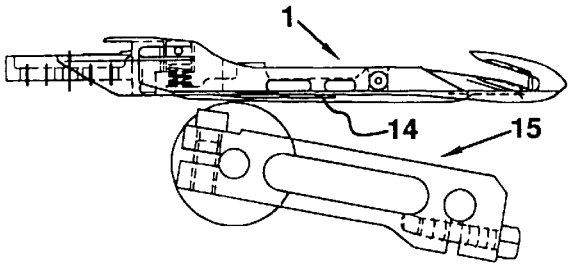
Figure 26C:
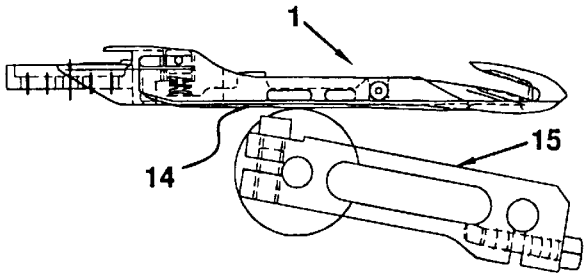
Figure 26D:
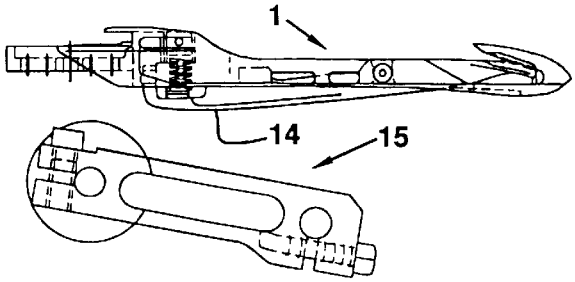

The operation of this embodiment of the invention is further illustrated on the basis of FIGS. 26*a* through 26*d*, in which the gripper rapier (1) is illustrated together with the drive roller (15) working together therewith for the clamping mechanism: when the drive roller (15) is pressed against the back of the clip shank (14)—see FIGS. 26*a* and 26*b*—the hinged clip is pressed open; through the adapted form of the lower side of the hinged clip the gripper rapier can move over several cm without the opening of the clip changing—see FIGS. 26*b* and 26*c*—; when the gripper rapier (1) and the drive roller (15) reach the situation in relation to each other shown in FIG. 26*d* the clip again (quickly) resumes its closed position.

What is claimed is:

1. Gripper rapier for weaving machines comprising a fixed gripper rapier body having a hook and a gripping face on an inside of the hook, a hinged clip suspended from the fixed gripper rapier body, the hinged clip being moveable between an open position and a closed position of the gripper rapier, a gripping face on the hinged clip working together with the gripping face of the hook for gripping a weft thread taken up by the gripper rapier, the gripping face of the hinged clip and the gripping face of the hook forming a wedge-shaped space with an extremity in the closed position of the gripper rapier, a projection in front of the extremity between said gripping faces projecting into the wedge-shaped space, a hole in the hook of the gripper rapier body or in the hinged clip, and the projection communicating with the hole for preventing the weft thread from sliding to the extremity of the wedge-shaped space.

2. Gripper rapier provision for weaving machines, comprising a fixed gripper rapier body having a hook and a gripping face on an inside of the hook, a hinged clip suspended from the fixed gripper rapier body, the hinged clip being moveable between an open position and a closed position of the gripper rapier, a gripping face on the hinged clip working together with the gripping face of the hook for gripping a weft thread taken up by the gripper rapier provision, the gripping face of the hinged clip and said gripping face of the hook at least in closed position of the gripper rapier provision forming a wedge-shaped space with an extremity, a projection provided in front of the extremity between the gripping faces, the projection projecting into the wedge-shaped space, a hole in the hook of the gripper rapier body or in the hinged clip, the projection working together with the hole for preventing the weft thread from sliding to the extremity of said wedge-shaped space, and a hole provided in the gripper rapier body near the gripping face of the hinged clip, for receiving a clip portion of the hinged clip upon opening of the gripper rapier provision.

3. The gripper rapier provision of claim 2, wherein the projection comprises a bar provided on the gripping face of the hook of the gripper rapier provision, the bar working together with the hole in the hinged clip for preventing the weft thread from sliding to the extremity of the space.

4. The gripper rapier provision of claim 2, wherein the projection comprises a bar running through an extremity of the hook of the gripper rapier body, the bar working together with the hole in the hinged clip for preventing the weft thread from sliding to the extremity of the space.

5. The gripper rapier provision of claim 2, wherein the projection comprises a bar provided on the hinged clip, the bar working together with the hole in the hook of the gripper rapier body for preventing the weft thread from sliding to the extremity of the space.

6. The gripper rapier provision of claim 2, wherein the projection comprises a projecting surface provided in an extremity of the hook of the gripper rapier body, the surface working together with the hole in the hinged clip for preventing the weft thread from sliding to the extremity of the space.

7. The gripper rapier provision of claim 2, wherein the projection is of a hardened material.

8. The gripper rapier provision of claim 1, wherein the projection is of a hard metal.

9. The gripper rapier provision of claim 1, further comprising strengthening ribs proximal the hole in the gripper rapier body.

10. The gripper rapier provision of claim 1, wherein in the closed position of the gripper rapier a portion of the hinged clip remote from the gripping face is adapted for projecting out of the gripper rapier body in a wedge-shape and in the open position of the gripper rapier provision the hinged clip is generally parallel to the gripper rapier body.

* * * * *